US010862255B2

(12) United States Patent
Barnett et al.

(10) Patent No.: US 10,862,255 B2
(45) Date of Patent: Dec. 8, 2020

(54) COMPACT TRAVEL PLUG

(71) Applicant: TRAVEL BLUE LTD., Edgware (GB)

(72) Inventors: Alasdair Max Paul Barnett, Cambridge (GB); Richard Albert Norman, Ely (GB); Bruce Stanley John Hutchison, Cottenham (GB)

( * ) Notice: Subject to any disclaimer, the term of this patent is extended or adjusted under 35 U.S.C. 154(b) by 0 days.

(21) Appl. No.: 16/305,868

(22) PCT Filed: May 27, 2017

(86) PCT No.: PCT/EP2017/000626
§ 371 (c)(1),
(2) Date: Nov. 29, 2018

(87) PCT Pub. No.: WO2017/207096
PCT Pub. Date: Dec. 7, 2017

(65) Prior Publication Data

US 2019/0341731 A1 Nov. 7, 2019

(30) Foreign Application Priority Data

Jun. 1, 2016 (EP) ..... 16001236

(51) Int. Cl.

| | |
|---|---|
| ***H01R 27/00*** | (2006.01) |
| ***H01R 31/06*** | (2006.01) |
| ***H01R 13/04*** | (2006.01) |
| ***H01R 13/46*** | (2006.01) |
| ***H01R 29/00*** | (2006.01) |

(52) U.S. Cl.
CPC ..... *H01R 31/06* (2013.01); *H01R 13/04* (2013.01); *H01R 13/46* (2013.01); *H01R 27/00* (2013.01); *H01R 29/00* (2013.01)

(58) Field of Classification Search
CPC ..... H01R 31/06; H01R 27/00; H01R 13/35; H01R 29/00
See application file for complete search history.

(56) References Cited

U.S. PATENT DOCUMENTS 4,626,052 A * 12/1986 Rumble ..... H01R 31/06 439/173
7,220,139 B1 * 5/2007 Chang ..... H01R 31/06 439/172

* cited by examiner

*Primary Examiner* — Felix O Figueroa
(74) *Attorney, Agent, or Firm* — Weiner & Burt, P.C.; Irving M Weiner; Pamela S Burt

(57) ABSTRACT

A travel plug adapter including a housing with inner walls, outer walls, and a bottom surface, a plug receptacle, and a first plug having a first contact pin. The first plug, by being displaced along a first distance, may be moved out of a standby position in the housing, into a usage position outside of the housing. A contact surface is provided in the housing and the plug is connected to an actuation element that, when the plug is moved into the usage position, comes into contact with the contact surface and that is connected to a transmission unit whereby the contact pin is moved across a second distance greater than the first distance.

20 Claims, 14 Drawing Sheets

COMPACT TRAVEL PLUG

FIELD OF THE INVENTION

The present invention relates to a travel plug adapter, which will also be referred to herein as a travel adapter, for short. Using such an adapter it is possible to insert power plugs of a certain (domestic) standard into the outlets present at the travel destination. To this end, the travel plug adapter needs a plug receptacle of a first standard and a power plug of another standard. In this case, the issue more precisely is a travel plug adapter that can be inserted into outlets of at least a first standard and a second standard. In addition, power plugs of a first standard and a second standard may be used alternatively in the travel plug adapter.

BACKGROUND OF THE INVENTION

Travel plug adapters or travel adapters of this type are being used more and more in times of increasing global travel and commerce. There is therefore a need for compact, easily transportable travel plug adapters that are suitable for outlets of a number of different standards.

Chinese patent application CN 101872911 A discloses a travel adapter having an essentially round housing. Power plugs are housed in the interior of the housing and may be moved out of the housing. In this manner at least three different types of power plugs may be used. The desired power plug is selected in that the upper housing part is rotated relative to the lower housing part. The upper housing part has an individual actuation slider that projects outward. This actuation slider may be caused to engage with various power plug elements. To this end it is rotated into a position above the power plug below that is to be moved out of the housing.

This travel plug adapter may be useful for many purposes. However, mechanically rotating the upper housing part relative to the lower housing part requires precise housing production in order to permit a low-resistance rotational movement and also to ensure that the actuation slider can be reliably caused to engage with a power plug element in various housing positions. In addition, the round shape is itself a limitation. In many cases, for instance, a block-shaped travel plug adapter may be perceived as being more easily transportable.

German patent DE 10 2011 014 920 B4 discloses another travel plug adapter, which is called a universal plug adapter. In this travel plug adapter, a plurality of sets of pins are provided in an exterior housing. Each set of pins is connected to a control element with which it may be moved from outside. The control elements are guided in the housing by slide slots. The control elements are also guided using a blocking plate provided inside the exterior housing. This blocking plate has a guide track, and the control elements can move through the recesses thereof. The guide track provides an upper end position and a lower end position. The blocking plate is resiliently prestressed so that a control element may be securely retained in the upper end position or in the lower end position. The control element, and thus the corresponding set of pins, may be released from the end positions and moved upward or downward in that a selector lever also provided outside in addition to the control elements is actuated. Pressing this selector lever moves the blocking plate against the spring force. In this way the pins may be moved out of their upper or lower end position using the control elements.

In this solution, the outer control elements are used both for moving the sets of pins out of a first end position, a standby position, into a second end position, a usage position, and for locking the sets of pins in these positions. It is a drawback that the selection lever must also be operated during the movement of the sets of pins using the control elements. This prevents comfortable one-hand operation. In addition, the control parts do not move freely in the slide slots, because the resiliently prestressed blocking plate is continuously pressed against the control elements during the movement. The length of the slide slots determines the distance by which a set of pins is slid out into its usage position.

The object of the present invention is to make available an improved travel adapter that avoids the drawbacks of the prior art. The travel adapter should be able to be produced cost-effectively and reliably, should be easy to transport and operate, and should be very safe electrically. In particular, it should take up little space, at least during its transport.

The inventive travel plug adapter has a housing that may have various shapes. For instance, as a rule a block shape is practical for transport. However, the mechanics of the travel plug adapter are designed such that the housing shape may largely be freely selected. It is advantageous when the housing has at least one flat side, but the mechanics may also be adapted to curved housing surfaces. The housing may be embodied in one piece or in a plurality of pieces. It has proved useful to embody the housing in two parts, specifically with a lower housing part and an upper housing part. These may be detachably connected to one another, for instance using mechanical means, usefully using a screw connection.

The housing should have at least one plug receptacle. The latter is usefully provided on the housing upper side. The plug receptacle may have different shapes, depending on the type of power plug (hereinafter "plug," for short) to be received. For instance, if a Schuko plug is to be received, the plug receptacle will have an essentially cylindrical depression and in addition female connectors for receiving the Schuko plug. For other types of plugs, no depression or groove is necessary. It may be useful to provide a flat upper housing side in which a plurality of female contacts are provided. As a rule, at least two female connectors should be provided that form a female connector pair for receiving a plug of a standard. It may be useful to provide a plurality of female connector pairs in order to be able to receive a plurality of plugs of different standards. If the plugs also have grounding conductors and the plug receptacle is intended to provide the opportunity of grounding, as a rule it is also necessary to provide a third female connector or a third contact per plug to be received.

The travel plug adapter should furthermore have at least one plug of a first standard. Frequently it also has other plugs, for instance and a second plug of a second standard. (Such plugs are sometimes also called plug-in pin sets). The plug of the first standard may be, for instance, an EU plug, and the plug of the second standard may be a UK plug. The plugs may have two pins, that is, they may not be grounded, or they may have three pins, so that a grounding pin may be provided.

Usefully, and as a rule, it is also necessary for the first plug and the optional second plug to be used alternatively.

The travel plug adapter may also comprise three or more plugs. Travel plug adapters with three or four plugs have proved to be very useful. At least one of the plugs, but as a rule all of the plugs, may be moved from a standby position, in which the plug is essentially disposed in the housing, to a usage position. In the usage position, the plug is usably disposed entirely or at least in part outside of the housing. Often it is possible for the plug to be moved completely back into the housing when it is returned to the standby position. It is useful that the plug may be moved far enough back into the housing that it is not in the way of other plugs.

According to the present invention, the travel plug adapter thus has a housing with inner walls, outer walls, and a bottom surface. As a rule the housing is single-walled, so that inner wall shall be construed to mean inner wall surface and outer wall shall be construed to mean outer wall surface. As a rule the bottom has openings that ensure that plugs may be moved through the bottom surface from the standby position into the usage position.

The at least first plug that the travel plug adapter comprises should have at least a first contact pin. Generally plugs have at least two contact pins. Also, frequently plugs have three contact pins, wherein the third contact pin is used for grounding.

A contact surface should be provided in the housing. This contact surface may be provided on an element disposed in the housing, but it may also be provided as part of an element of the housing that is provided, in part or essentially, for making available the contact surface. Projections, for instance a projection on an inner wall of the housing, may be a useful contact surface.

In the context of the invention, the plug has at least on actuation element or is connected to such an actuation element. The actuation element may take a number of useful forms, for instance it may be an actuation button or an actuation lever.

In the context of the present invention, when the plug is moved from the standby position into the usage position, the actuation element should come into contact, at least temporarily, with the contact surface. In this, the contact surface exerts pressure on the actuation element. Temporary contact between the actuation element and the contact surface is enough for this, but it is also possible for the actuation element to be contact with the contact surface during the entire movement of the plug from the standby position into the usage position. It is also possible for the actuation element to engage with a contact surface (for instance, if the contact surface is provided by a groove).

As a rule, the plug is moved from the standby position into the usage position using a linear movement. The plug moves across a first distance. The first distance corresponds to the distance across which a support element (if one is provided) that bears the contact pins moves, e.g. a support arm or support body. During this movement, force is then exerted onto the actuation element by the depression of the actuation element against the contact surface at the same time as the force that is used to move the plug.

The actuation element should be connected to a transmission unit such that using the transmission unit the at least one contact pin of the first plug is moved across a second distance that is longer than the first distance.

For instance, the first distance may be 40 to 90% or even 60 to 80% of the second distance.

The possibility of moving at least one contact pin of a plug across a longer distance than the plug itself is moved may, in various circumstances, be advantageous for a travel plug adapter. For instance, if the travel plug adapter comprises plugs of a different standard, it may be necessary for plugs of a certain standard to be moved further out of the housing than plugs of another standard.

This is particularly the case for a Euro plug compared to a US plug. The US plug comprises two contact pins. The Euro plug, however, comprises a plug body from which two contact pins (broadly speaking) project approximately the same distance as the contact pins in the US plug. The contact pins of the Euro plug are approximately equal in length to the contact pins of the US plug. Therefore the Euro plug must be slid out of the housing by a longer distance that is approximately equal to the height of the plug body of the Euro plug. This may be achieved in that an actuation slider allocated to the Euro plug is displaced across a longer distance than, for instance, the actuation slider allocated to the US plug. However, this solution is not always satisfactory. It is perceived as aesthetically more pleasing and also as more user-friendly when all actuation sliders are to be displaced by exactly the same distance or at least by approximately the same distance. This also permits a more compact design of the housing.

In the context of the present invention, suitable means were developed to achieve this. Part of the inventive solution is a transmission unit. The transmission unit includes mechanical means that permit a (shorter) movement of the plug to effect a longer movement of at least one of its contact pins.

To this end, the transmission unit may comprise or be a gear mechanism. Such a gear mechanism may consist of at least two gear wheels. For instance, two toothed wheels may be provided. A first toothed wheel may be brought into contact with the contact surface on the housing. Usefully, teeth with which the toothed wheel can engage would be provided there. The first toothed wheel could itself be engaged with a second toothed wheel (of a different effective diameter) that acts on the contact pin to be moved. To this end, teeth that also engage with the second contact wheel could also be provided on the contact pin. Friction wheels could also be used instead of toothed wheels. For instance, a friction wheel could run on an inner wall of the housing.

It is likewise useful when the transmission unit is an angle lever or comprises such an angle lever. The provision of an angle lever permits a particularly simple transmission unit, the most essential part of which is actually the angle lever. The first leg of the angle lever may act as actuation element. A second leg of the angle lever may act on the contact pin or pins that are to be moved the second distance. The second leg of the angle lever could also act on the plug body, for instance of a Euro plug.

It is particularly useful when the first plug supports the angle lever. To this end, the first plug may comprise an axis that supports the angle lever and about which the angle lever may rotate. If the plug comprises a support arm, the latter may support the at least one angle lever. If the plug comprises a plug body, the latter may support the at least one angle lever. It may also be useful when a plug has two angle levers, for instance opposing one another. Consequently, a plug may then also have two axes.

As explained, especially with the Euro plug it is of interest if it can be moved across a longer second distance. Therefore the first plug may advantageously be embodied as a Euro plug. A Euro plug may in particular comprise a plug body that supports two angle levers, e.g. arranged opposing one another.

It is also useful when the first plug is embodied as a UK plug. It is again particularly useful when the ground contact of the UK plug moves by the second distance.

Also entirely useful is a travel adapter in which both a first plug, for instance a Euro plug, and also a second plug, for instance a UK plug, each have an actuation element that is connected to a transmission unit in the described manner.

It is useful when the contact surface is provided on the inner wall of the housing. For instance, the contact surface may be formed by a surface on a projection. It is also useful, however, when a part of the bottom surface of the housing acts as contact surface.

To move it from the standby position into the usage position, the first plug may be connected with an actuation slider. The second plug may also possibly be connected to an actuation slider for moving it from the standby position to the usage position. Thus the travel plug adapter often has at least a first actuation slider and a second actuation slider. The actuation sliders may usefully be embodied in a button-like manner so that they are easy to move with one finger. For the actuation sliders, slide slots may be provided in the housing. Slide slots may also be connected to one another so that a guide track for the actuation sliders results. As a rule it is useful to provide one slide slot per actuation slider and to arrange these slide slots parallel to one another.

A sliding selector that may be moved into at least a first position and a second position may be provided on the travel plug adapter. In its first position releases, this sliding selector alternatively the first plug and in its second position releases the second plug so it can be moved into the usage position.

In this manner the sliding selector offers a practical additional benefit for the travel plug adapter. It is not unusual for a travel plug adapter to be taken to the same destination country multiple times. It is also common that in a destination country the required plug will be moved out of the usage position back to the standby position while it is not needed. It is therefore advantageous when the corresponding plug type can be adjusted on the sliding selector. It is very simple to label the sliding selector such that the destination country may be easily legible and adjustable on it. Once the sliding selector is then moved into the appropriate position, only the corresponding plug may be moved into the usage position. As a rule, this means that it is also only possible to displace one actuation slider.

Since the travel plug adapter should always be constructed compactly, the actuation sliders are generally situated very close to one another. It may therefore easily happen, for instance, that a finger is not placed precisely on the actuation slider and an adjacent actuation slider could be inadvertently displaced at the same time. When a sliding selector is provided, only the actuation of one plug enabled, and therefore (as a rule) also only one actuation slider, therefore the actuation slider that is inadvertently also touched does not move (or it does not move the associated plug, at least). This renders operation of the travel plug adapter more error-tolerant.

The plugs may, for instance, be moved into the usage position using the actuation sliders. It is important for safe use of the travel plug adapter that the plugs also remain in the usage position even when they are inserted into an outlet against a pressure. In the framework of the present invention, an arresting or locking element may be provided to ensure that the plugs remain in the usage position and to arrest them there. This locking element may arrest at least one plug of the travel plug adapter; the locking element may also usefully arrest a plurality of or all of the plugs in the usage position. Especially the element projecting the farthest must be able to absorb this pressure, i.e. as a rule at least a contact pin that is moved by the transmission unit.

The optional locking element is usefully designed as a separate component from the sliding selector. The embodiment as a separate component has production advantages. The sliding selector is a component that does not have to convey or withstand large forces. However, due to its nature, the locking element must exert enough force to hold a plug of each standard in the usage position.

For similar reasons it is useful when the locking element is also a separate component from the actuation sliders. In this case the locking element shall be construed to be a separate component when it has at least one component that is not also a part of the sliding selector or an actuation slider. In general, it is useful when all components of the locking element are embodied separately from the components of the sliding selector and also from the components of the actuation sliders.

It is useful when the locking element, if provided, is connected to a release button that is provided on the exterior of the housing and is to be actuated in a release direction. Such a release button permits intuitive and safe release of the locking element when a plug is to be moved out of the usage position back into the standby position. This design appears safer and more reliable than those in which certain movements of the actuation slider or even the sliding selector or even the plug itself lead to releasing the plug. So that the release button cannot be actuated inadvertently, it may also be provided with warning indicators or be designed in a warning color, for instance in red. The release button may be part of the housing, for instance if due to suitable design a part of the housing can be depressed. As a rule it is useful to provide a recess in the housing and to provide the release button in this recess as a part that is independent of the housing. The release button may usefully be arranged opposing the sliding selector and/or the actuation sliders.

It is useful when the locking element is resiliently prestressed (typically: spring biased) against the release direction. Resiliently prestressing the locking element permits plugs to be reliably snapped into a lock as soon as the plugs are in the usage position. It is also advantageous mechanically when the springs act precisely against the release direction.

A useful embodiment of the locking element is an embodiment in which the locking element has at least one locking leg and this locking leg has a slide surface and a locking projection. An element that is connected to a moved plug may slide on the slide surface. This element may then snap in at the locking projection so that the plug connected to the element is locked.

A travel plug adapter is useful in which at least one plug has a sliding projection or is mechanically securely connected to such and the sliding projection runs on the slide surface and can assume a locking position on the locking projection.

Also useful is a travel plug adapter in which the locking means has a plurality of locking legs, for instance two, three, or four locking legs. The number of locking legs may be exactly the same as the number of plugs. It may also be useful and sufficient when the number of locking legs is less than the number of plugs.

Especially in the latter case it is useful when at least two plugs are each connected to a sliding projection and both sliding projections run on the same locking leg of the locking element. Since the two sliding projections run on the same locking leg, this means that the two sliding projections run on the same slide surface and on the same locking projection on which the two sliding projections can assume a locking position. Because two plugs in the travel plug adapter are not supposed to be moved into the usage position at the same time, the sliding projections alternatively assume this locking position on the locking projection. However, if two sliding projections, for instance two sliding projections of adjacent plugs, share a suitably dimensioned locking leg, the number of locking legs may be reduced and the travel plug adapter may thus be constructed even more compactly.

In the context of the present invention, a sliding selector may be provided in any suitable form. As a rule, it will mechanically permit the movement of only one plug and will prevent the movement of the other plugs. Usefully, the optional sliding selector may act on the actuation sliders, each of which is connected to a specific plug. It may also be useful when the sliding selector acts on another element connected to the plugs.

The sliding selector may have a sliding selector body. The latter may be placed inside the housing of the travel plug adapter. It is then useful to provide a recess in the housing, which recess permits the operation of the sliding selector. For instance, an actuation button, hereinafter also called a sliding selector button, may be accessible through the recess. It is also possible for the sliding selector body to be placed on the outside of the housing, and for it to act outside the housing, on the actuation sliders, or for it to act interiorly on the actuation sliders by means of a through-hole.

At least one plug or all plugs may be connected to an engaging element that cooperates with the optional sliding selector such that the plug is prevented from moving into the usage position. Usefully, the engaging element may be embodied as a cam or in general as a projection. The movement of the engaging element may be prevented by a blocking element of the sliding selector, for instance by a blocking bar, a blocking cam, or the like. The blocking cams are usefully arranged in series so that the cams form a comb-like blocking strip. Depending on the position of the selection element, it should also be possible that the movement of an engaging element is not prevented but instead its passage is permitted. To this end, the blocking element may advantageously have recesses that permit the passage of the engaging element. For instance, a series of projections and depressions may be provided on the sliding selector.

It is useful when the housing of the travel plug adapter has slide slots. The actuation sliders may run in these slide slots. A slide slot may also be provided for the sliding selector. Slide slots permit the movement of a slider while it is also being guided. Thus they represent an advantageous and cost-effective mechanical solution. Since, as a rule, a plurality of actuation sliders are provided on the travel plug adapter, it is particularly advantageous when they may be guided in the slide slots in a simple manner.

As explained, it is advantageous when the position of the optional selection element can no longer be changed as soon as a plug is moved into the usage position. To this end, a latch element may be provided. The latch element is usefully provided on the sliding selector or is connected thereto. Latch element and sliding selector may represent an integral component or at least a connected complete component.

A latch element that has a first functional element for cooperating with the first plug and a second functional element for cooperating with the second plug is useful. In order to permit simple and cost-effective production of the latch element, it is useful when the first functional element and the second functional element are constructed in the same manner. The first functional element and the second functional element may each be made available from identical components or similar component sections.

It is particularly useful when the latch element has fingers that can engage in receiving elements that are securely connected to the housing. The functional elements may usefully be embodied in the form of fingers. The latch element may also have projections or cams instead of fingers. The receiving elements may be configured, for instance, as projections or depressions in a latch guide. The receiving elements could also be configured as recesses or holes in the housing or in a component connected to the housing.

It is useful when the latch element includes a spring element. It is even possible for the latch element to be formed overall from a spring element, for instance by a flat (or leaf) spring. The fingers of the latch element may be resiliently prestressed using such a spring. The direction of the spring force is into the receiving elements on the housing. The springs are prevented from projecting into the corresponding receiving elements as long as all of the plugs are in the standby position.

It is useful when one finger of the latch element is pressed into a recess towards the spring force as soon as a plug is moved into the usage position.

It is useful when the spring element of the latch element resiliently preloads its fingers in the direction of the receiving elements that are for the fingers and that are connected to the housing. The fingers may then usefully be prevented from engaging in the corresponding receiving elements using elements securely connected to the plugs as long as the plugs are in the standby position. It is useful, for instance, when parts of the actuation sliders assume this task. For instance, the actuation sliders may be connected to the slide surfaces that slide along on the fingers when the actuation sliders are moved into the usage position, but in the usage position release them so that the finger allocated to the actuation slider dips into a recess allocated to the finger.

Additional features, but also advantages, of the invention, result from the drawings in the following and the associated description. Features of the invention are described in the figures and associated descriptions in combination. These feature may, however, also be included in other combinations of an inventive subject matter. Each disclosed feature should thus also be considered to be disclosed in technically reasonable combinations with other features. Some of the figures are have been slightly simplified and are diagrammatic.

FIG. 1 is a perspective representation of an exemplary embodiment of an inventive travel plug adapter;

FIG. 2 provides a representation, from the same perspective, of the exemplary embodiment of the travel plug adapter in which the Euro plug has been moved to the usage position;

Figure 1:
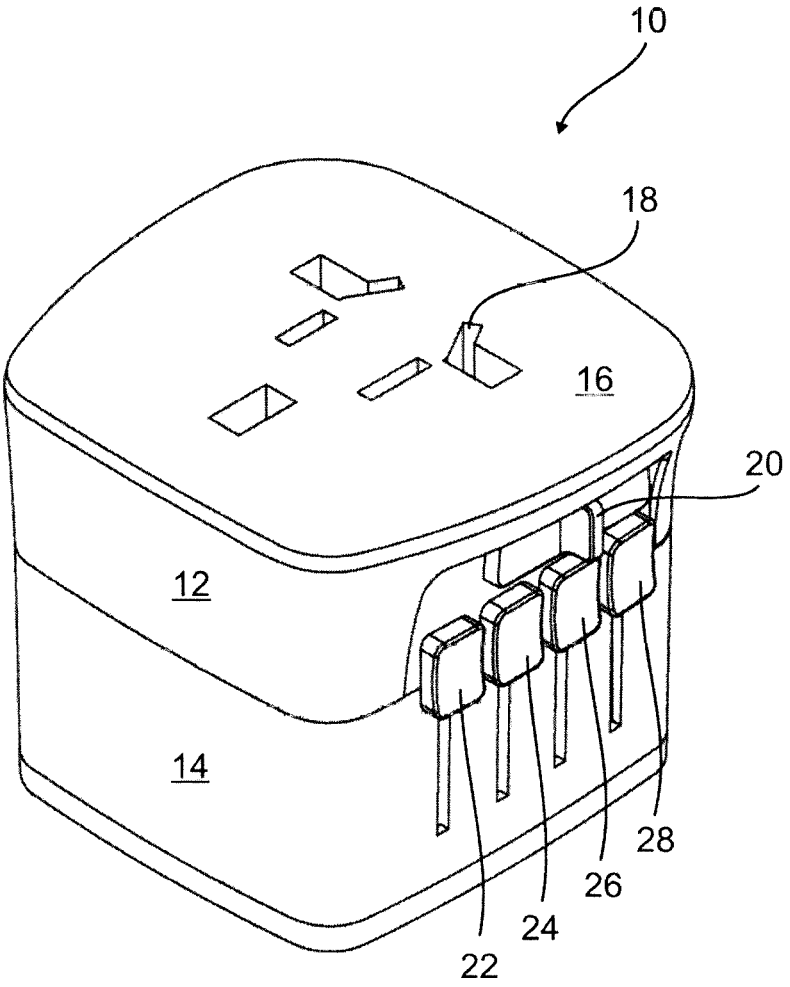
FIG. 1 is a perspective representation of an exemplary embodiment of an inventive travel plug adapter that is ready for use, but is not yet in the usage position. Instead, all of the plugs are in the standby position, i.e., in the housing.

In the following, first the most essential elements of the travel plug adapter 10 shall be described. The travel plug adapter has a housing that consists of an upper housing part 12 and a lower housing part 14. Disposed on the top side of the travel adapter plug, and thus in the area of the upper housing part 12, is the plug receptacle 16. The latter has a plurality of female connectors 18. A sliding selector button 20 is provided on the front side of the travel plug adapter 10. Various actuation sliders may be selected and released via the sliding selector button 20. Provided below the sliding selector button 20 are a first actuation slider 22, a second actuation slider 24, a third actuation slider 26, and a fourth actuation slider 28.

Figure 2:
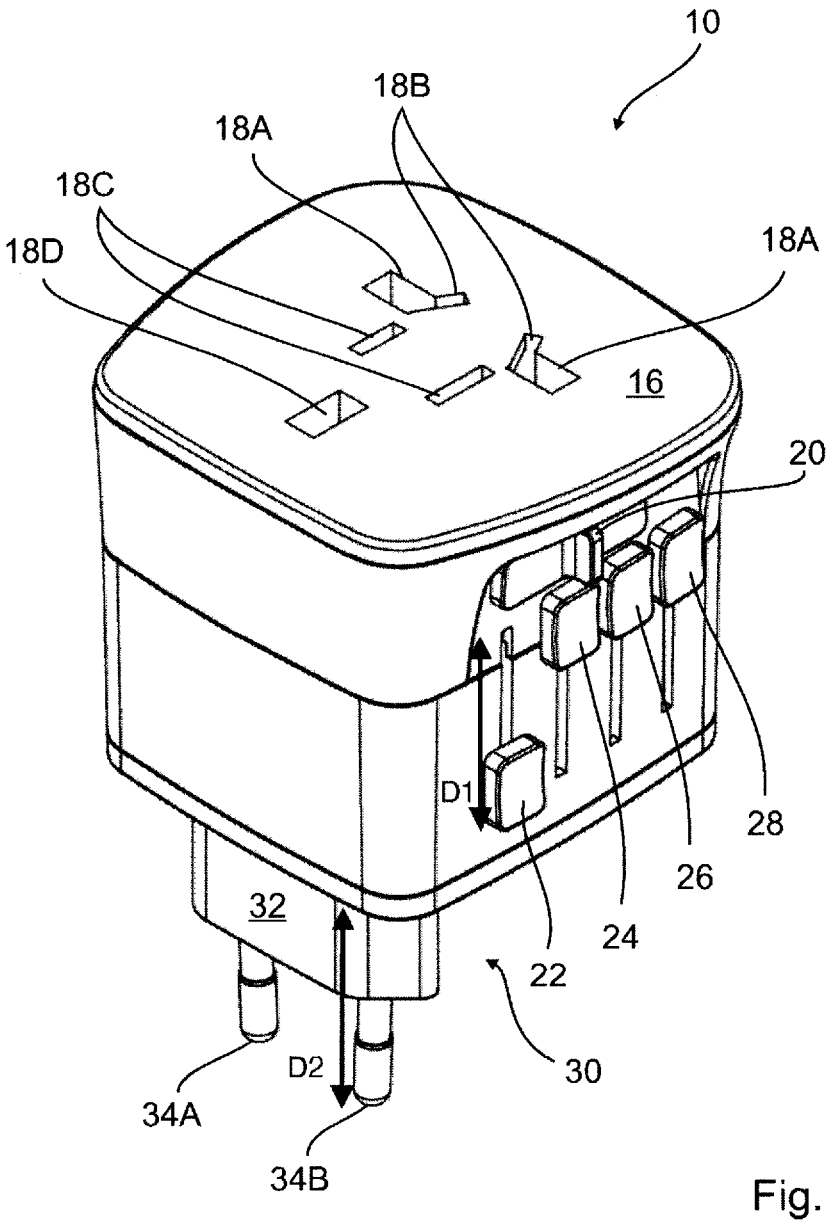

FIG. 2 illustrates the same travel plug adapter from the same perspective depiction. However, in this travel plug adapter one plug has been moved into the usage position. Consequently the sliding selector button 20 is in the position at the left end of its slide path. In this position, the left actuation slider, that is, the first actuation slider 22, is released. The actuation slider 22 is moved from the upper position into the lower position. Because of this, the Euro plug 30 projects downward. This Euro plug has the plug body 32, as well as a first contact pin 34A and a second contact pin 34B. In this manner the travel plug adapter 10 may be inserted into an outlet according to the Euro standard. Female contact pairs are then available on the top side of the travel plug adapter and permit plugs that do not correspond to the Euro norm to be inserted. These are, specifically, the UK female connector pair 18A, the AUS female connector pair 18B, das US female connector pair 18C, and the connector 18D for the UK grounding pin.

Figure 3:
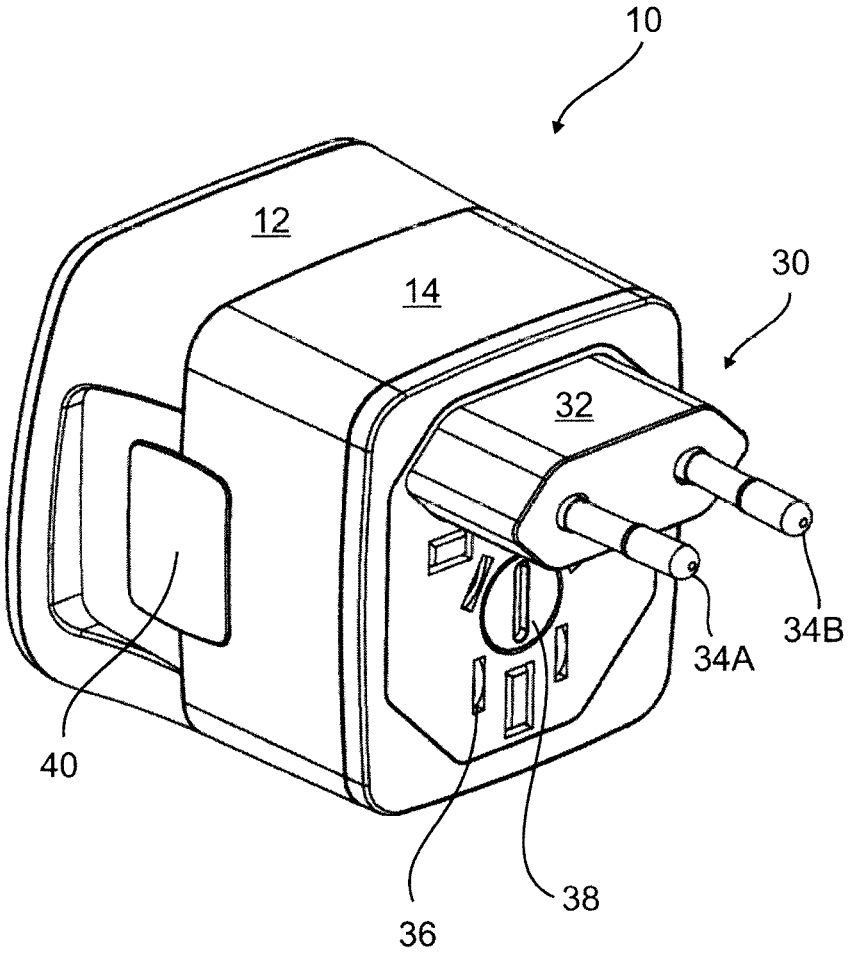
FIG. 3 illustrates the exemplary embodiment, in which the Euro plug has been moved to the usage position, from another perspective.

FIG. 3 illustrates the same plug from another perspective. The plug is in the same position as in FIG. 2, i.e., the Euro plug has been moved into the usage position. It may be seen on the bottom of the housing that even more contact pins 36 are provided, that is, contact pins for other standards. Furthermore, a fuse insert 38 is provided on the bottom. This insert is closed to the outside with a visible cover, the slit of which may be turned, for instance, with a coin in order to remove the cover and exchange a fuse.

Furthermore, the release button 40 is provided on the housing side that was not visible in the previous illustrations. This release button is received by a housing recess. More precisely, provided in both the upper housing part 12 and in the lower housing part 14 is a recess, and these together surround the release button 40. Pressing the release button makes it possible to return a plug that has been pushed downward, like the Euro plug 30 in this case, back into the housing. However, while the release button is not actuated, the plug may not be pressed into the housing, so that cannot also happen unintentionally when the plug is being inserted into an outlet.

Figure 4:
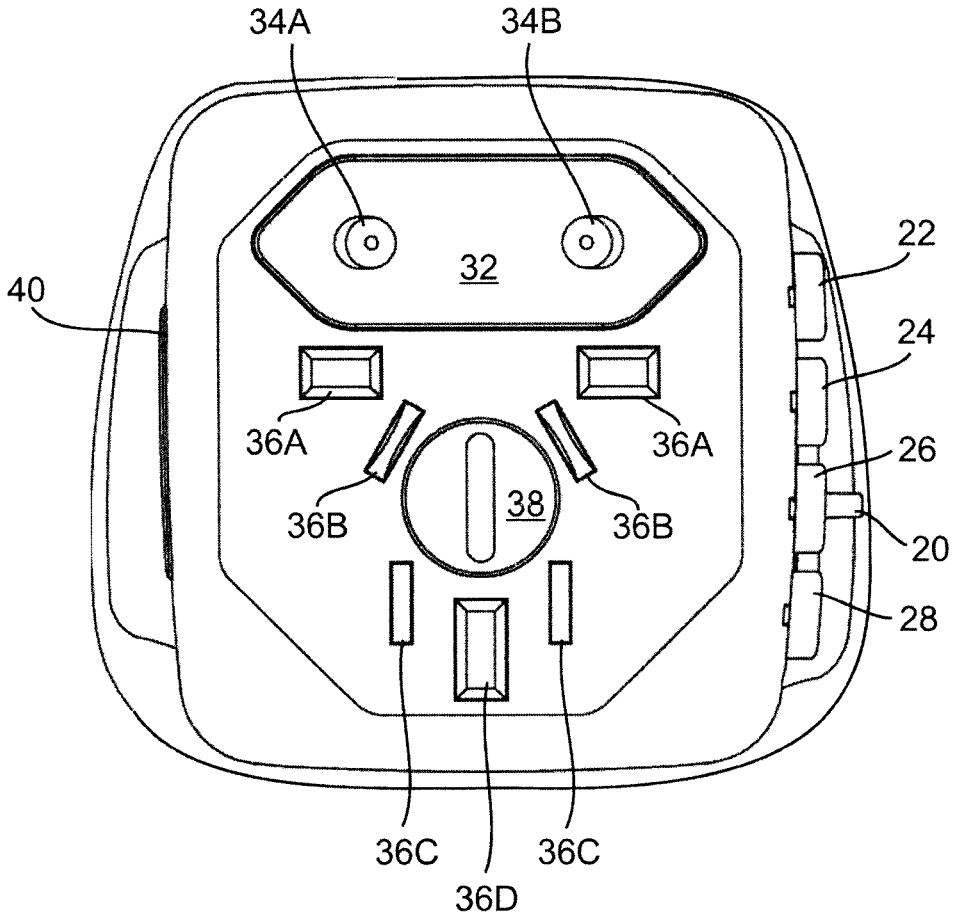
FIG. 4 illustrates the exemplary embodiment from below.

FIG. 4 illustrates the bottom of the same travel plug adapter. Here it is possible to see other details more precisely and these shall therefore be discussed in connection with this figure. The bottom view illustrates that the actuation sliders 22 through 28 and also the sliding selector button 20 do not project far beyond the lateral housing surface. The engineering of the present invention permits a compact, yet user-friendly, arrangement in which the actuation sliders are arranged very close to one another. The sliding selector button 20 is somewhat higher than the actuation sliders and therefore projects slightly beyond them.

The contact pins 34 for the Euro plug are guided in a plug body 32. The contact pins for plugs of other standards are guided out of the bottom of the housing, without an additional plug body being provided. At least two contact pins each, that is, a pair of contact pins, are provided for outlets of standards of different counties. The contact pin pair 36A is provided for Great Britain, and hereinafter is also called UK contact pins. The contact pin pair 36B is for Australia, and hereinafter is also called AUS contact pin pair. The contact pin pair 36C is provided for the US, and hereinafter is also called the US contact pin pair. A grounding terminal 36D is also provided. This grounding terminal is provided for the United Kingdom and is therefore also called a UK grounding terminal. It is possible to ground using this contact. However, as a rule such a contact may also be provided when no ground terminal is being used. In that case, this contact is an opening pin for a UK outlet. The opening pin makes it possible for the other two contacts to be inserted.

It may be seen that the release button 40 is provided exactly opposite the actuation sliders and sliding selector button. In the context of the present invention, it is quite useful to provide the sliding selector button and all actuation sliders on one housing side. For safe and intuitive handling, in general it is also useful to provide the release button 40 opposite thereto.

Figure 5:
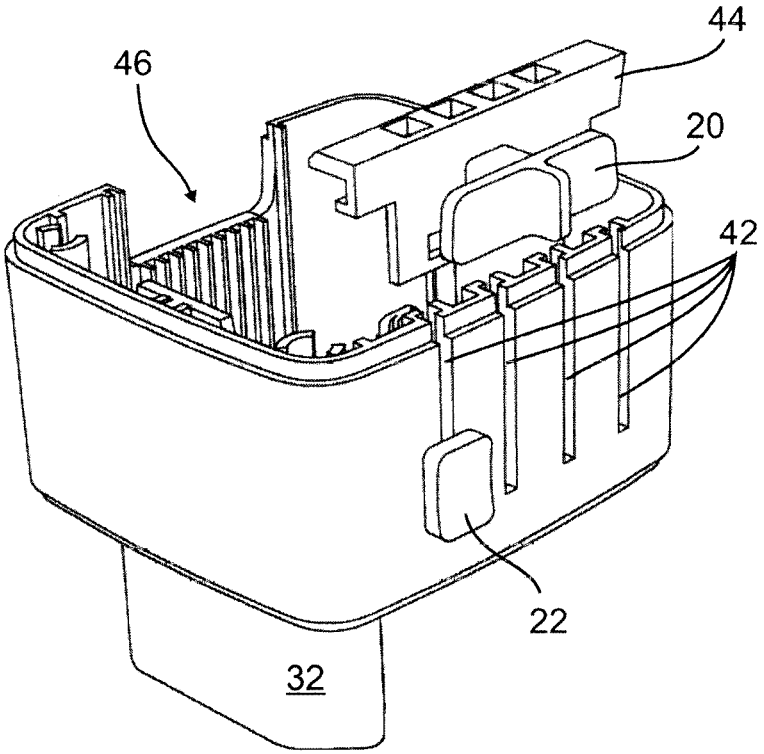
FIG. 5 is a perspective elevation of selected cooperating components.

FIG. 5 illustrates in a perspective representation selected cooperating parts of the exemplary embodiment of a travel plug adapter. The lower housing part 14 is illustrated. The plug body 32 that belongs to the Euro plug is disposed below the housing. Corresponding to the position of the plug body 32, the first actuation slider 22 is illustrated in a lower position. On its front the housing has slide slots 42. Four adjacently arranged slide slots 42, each of which can receive an actuation slider, may be seen. For the sake of easier understanding, however, only the first actuation slider 22 is depicted. The sliding selector body 44 may be seen above the slide slots. The recess 46 for the release button may be seen opposite the sliding selector body 44.

The sliding selector body is depicted in the position in which it is used in the complete travel plug adapter, as well. However, it is depicted without the parts that retain it in this position. This simplified representation is also for the purposes of easier understanding. It is useful to arrange the sliding selector body 44 above the actuation sliders, i.e. opposite the housing bottom out of which contact pins may be guided and moved into the usage position.

Figure 6:
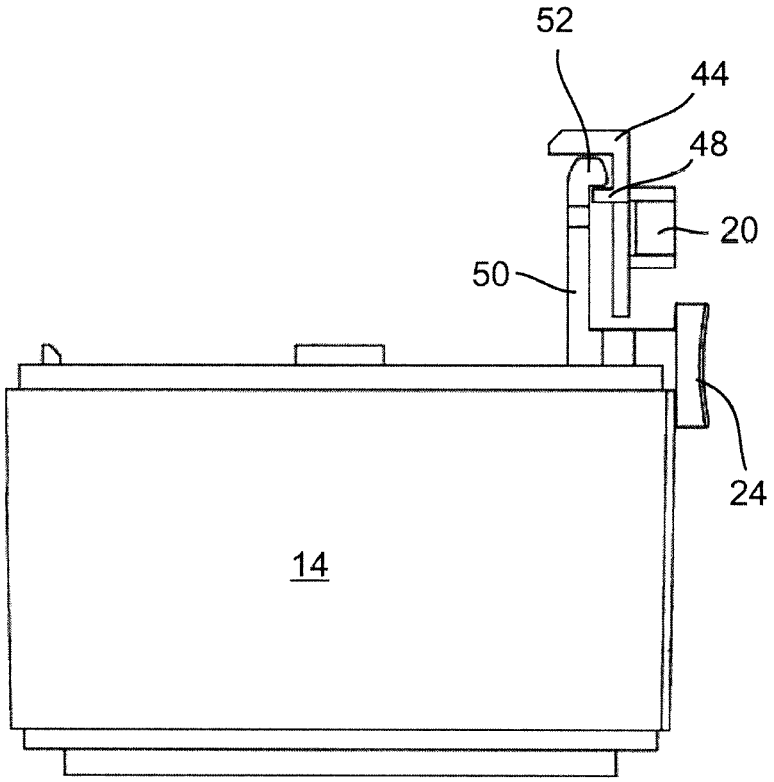
FIG. 6 is a side view of the components from FIG. 5.

FIG. 6 essentially illustrates the elements depicted in FIG. 5 from a side perspective. Depicted once again are the lower housing part 14 and the sliding selector body 44. The sliding selector body 44 is again depicted in the position in which it is retained by other components (not illustrated). Furthermore illustrated is the second actuation slider 24 adjacent to the first actuation slider 22. While the first actuation slider 22 is depicted in a lower position, that is, a position corresponding to the usage position of the plug, the second actuation slider 24 is depicted in an upper position, that is, a position corresponding to the standby position.

In this view it may be seen that the back side of the sliding selector body 44, which faces the interior of the travel plug adapter, has a blocking cam 48. It may furthermore be seen that the first actuation slider is connected to a guide arm 50. This guide arm 50 may additionally be supported by components that are not shown and then ensures that the position and movement of the actuation slider 22 is not defined solely by the slide slot 42. As a rule, however, the actuation sliders being guided solely in slide slots is sufficient. An engaging cam 52 is embodied at the upper end of the guide arm 50.

The engaging cam 52 may thus be caused to engage with the blocking cam 48 such that a downward movement of the second actuation slider 24 is prevented. When the sliding selector 44 is in a different position, the engaging cam 52 is not engaged with the blocking cam 48, however.

Figure 7:
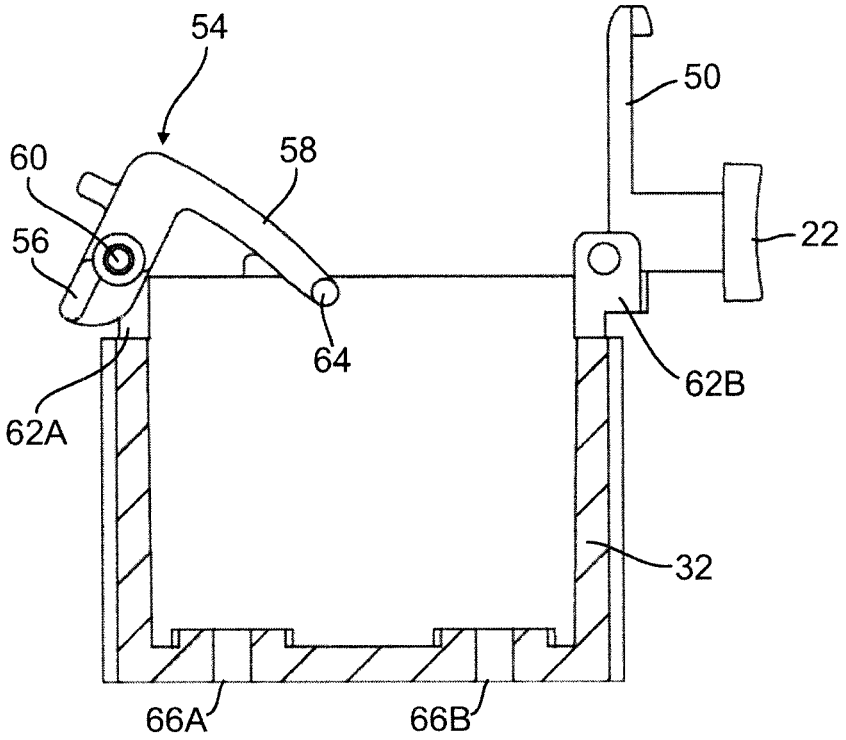
FIG. 7 is a side view of selected cooperating components.

FIG. 7 is a side view of selected cooperating components. The plug body 32 of the Euro plug is shown. The first actuation slider 22 is connected to this plug body. Also visible is the guide arm 50, the functioning of which has already been discussed.

Also visible in this depiction is an angle lever 54 connected to the plug body 32. The angle lever has a first leg 56 that acts as the actuation element in the context of the present invention. Connected to the first leg is the second leg 58. It is essentially at a right angle to the first leg 56. The axis 60 is provided near the inflection point at which the two legs meet one another. In the context of the present invention, an axis offset to the inflection point is generally a useful design. The angle lever 54 at this site has a through-hole that receives the axis 60. The axis 60 is provided as a short round tube piece. The axis 60 is borne on a bearing element 62A of the plug body 32. This bearing element 62A essentially has two opposing openings (mirror-image to the plane of the drawing) and encloses the angle lever 54.

It may also be seen that two bearing elements are provided on the plug body 32, specifically the bearing elements 62A and 62B. Even though only one angle lever is depicted in FIG. 7, it is possible, and frequently also useful, for a second angle lever to be provided opposite.

When the plug body is disposed in its standby position in the housing, the angle lever assumes a position in which the second leg 58 is disposed in an approximately horizontal position. The first leg 56 is then disposed in an approximately vertical position.

Figure 8:
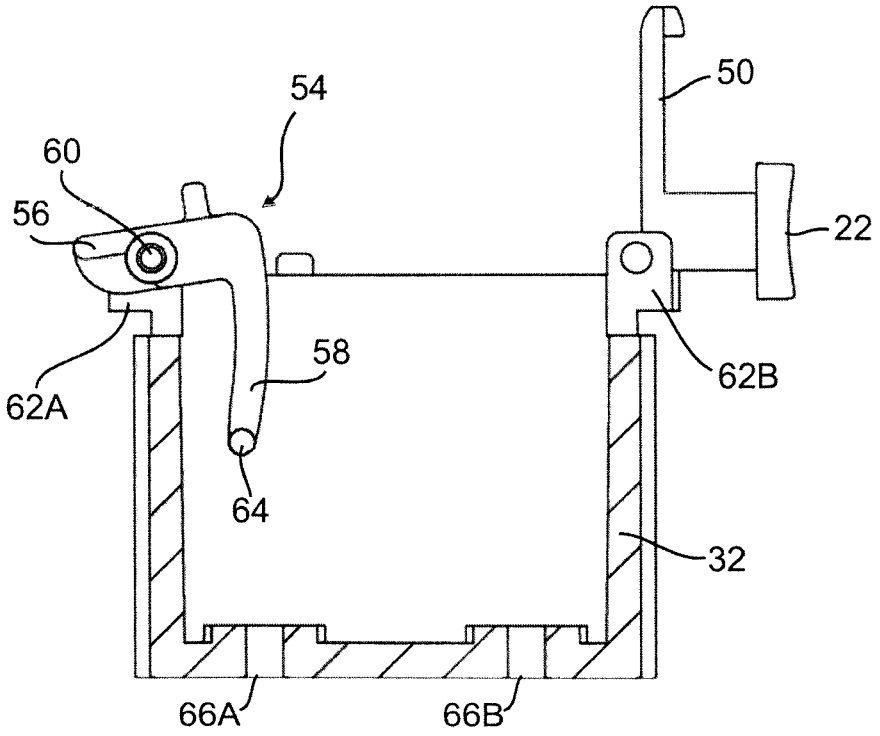
FIG. 8 illustrates the components from FIG. 7 in a different functional position in the same side view.

FIG. 8 illustrates the components depicted in FIG. 7. In FIG. 8, however, the angle lever is depicted in a different position, specifically in the position it takes when the plug body 32 has been slid into the usage position. In this position, the second leg 58 is oriented downward. The end of the second leg may then exert pressure for instance on the contact pins or even on another contact surface of the plug body. Due to this pressure, the plug body 32 and/or the contact pins are moved all the way down and into a usage position projecting out of the housing. The first leg 56 assumes a nearly horizontal position. The end of the first leg 56 (embodied as a rounded end) may be moved into this position using pressure from below.

The pressure on the first leg 56 may be exerted by a contact surface that is provided on the housing. When the plug body 32 is moved by displacing the actuation slider 22, the contact surface presses against the end of the first leg 56. Because of this, this leg is moved into the illustrated position, in which the second leg projects downwards and as a rule out of the housing.

Figure 9:
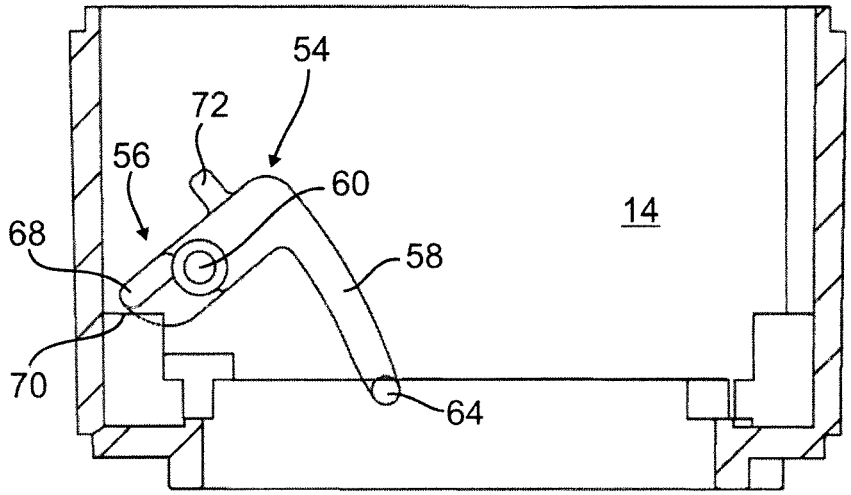
FIG. 9 is a side view of selected cooperating components.

FIG. 9 provides a side view of the cooperation of the angle lever 54 and the housing. The housing is represented by the lower housing part 14. The angle lever 54 and axis 60 are depicted. This axis 60 is supported by a plug, for instance by the Euro plug 32 depicted in the previous illustrations. Neither the plug nor a bearing element 62 (provided as a rule) are depicted, however, in order to render the depiction simpler and easier to understand.

At its end, the first leg 56 has the contact projection 68. it may be in contact with a contact surface 70 provided, for instance, on the housing. It could also engage with a projection or a groove or the like.

The guide projections 72 and their functioning may be seen in this depiction. The guide projections 72 may ensure that the first leg 56 does not strike the contact surface 70 at a perpendicular and thus a rotational movement is reliably introduced.

In FIG. 9, the element of the housing that has the contact surface 70 is configured such that the contact projection 68 is positioned laterally against the contact surface 70, while a recess receives the rounded end of the first leg. This recess acts as a guide groove that runs approximately in the plane of the drawing. Such an additional guide is not absolutely necessary, however, so that the contact surface may also be formed using a simple projection. Providing a contact projection is likewise a useful option in the context of the present invention, but is not required.

Figure 10:
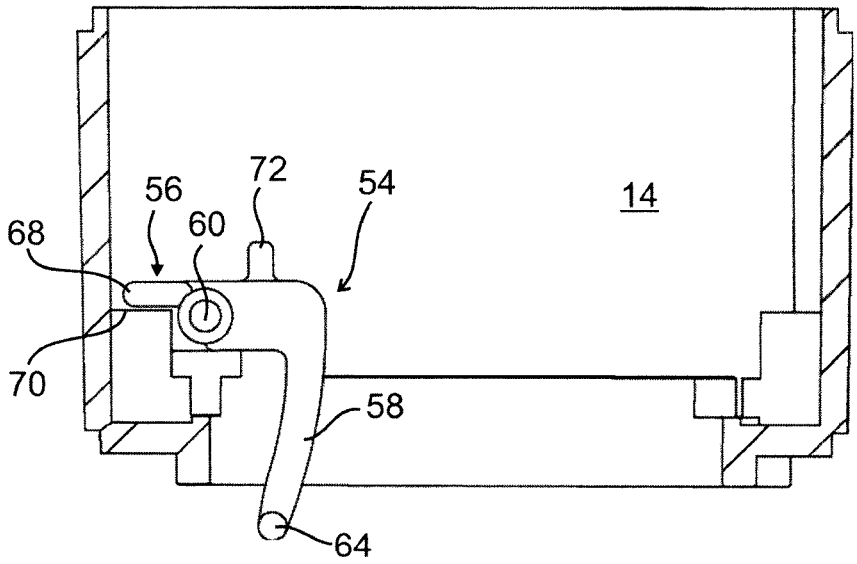
FIG. 10 illustrates the components from FIG. 9 in a different functional position in the same side view.

FIG. 10 illustrates the components known from FIG. 9. Analogous to FIG. 8, in this case, however, the angle lever 54 is shown in its terminal position. In this terminal position, the contact projection is positioned flat against the contact surface 70.

The lever angle is thus illustrated in the position it takes when the plug body 32 supporting it is moved out of the housing 14. Consequently, the second leg 58, at least at its end, and with the end pin 64, projects and beyond the lower housing part 14.

The first leg 56 presses against the contact surface 70. The contact surface, provided somewhat above the housing bottom, therefore causes the angle lever to move into the illustrated position.

When a plug is actuated, due to the relative movement of the lever angle and the contact surface 70, the first leg 56 always comes into contact with the contact surface 70 and, as the relative movement continues, moves about its axis 60. This is how it is moved into the illustrated terminal position in which the end of the second leg 58, possibly with the optionally provided end pin 64, presses the associated plug and/or its contact pins downward into the usage position. The end of the second leg 58 in general does not have to have an end pin 64, however a rounding about the axis perpendicular to the viewing direction is useful because the angle of the second leg relative to its pressure point on the associated plug (plug body and/or contact pin) is variable during the movement from the standby position into the usage position.

Figure 11:
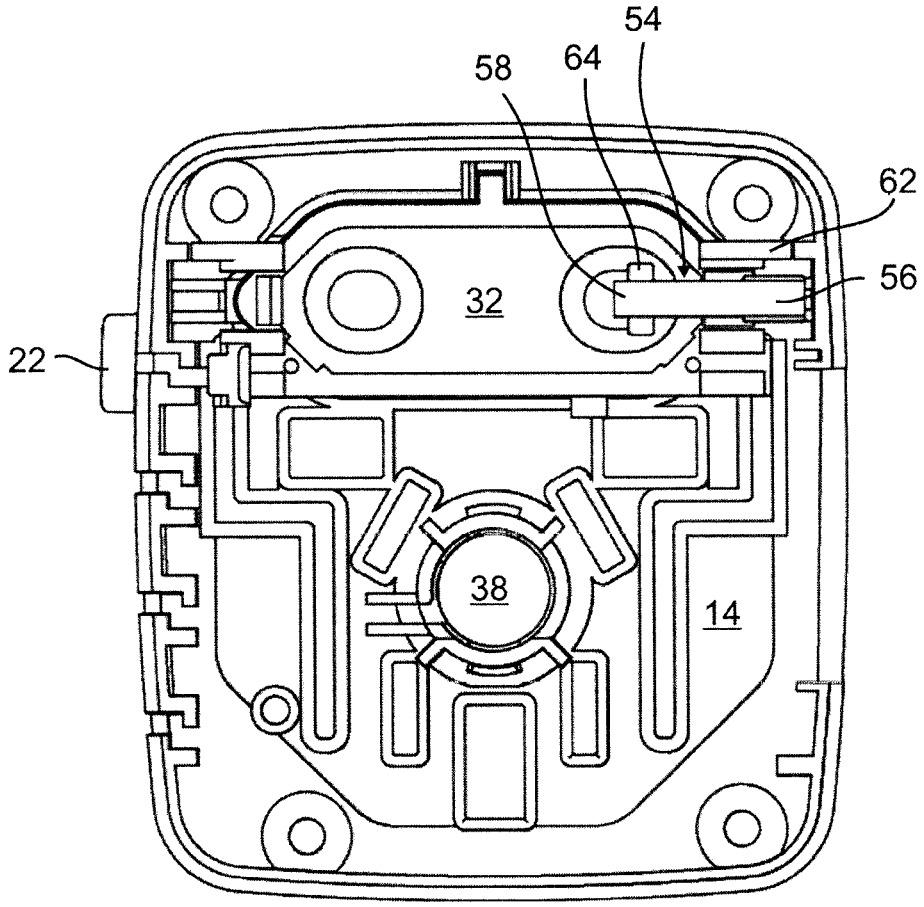
FIG. 11 is a top view of components depicted in FIG. 9 and FIG. 10.

FIG. 11 is a top view of selected cooperating components. The view is onto the bottom surface of the lower housing part 14. Openings for the contact pins of different standards and the opening 38 for the fuse insert may be seen. Since, for the sake of clarity, only selected components are depicted, again only the plug body 32 of the Euro plug and the associated first actuation slider 22 are depicted. It is very easy to see how the angle lever 54 is supported by the axis 60. The latter is itself held by the bearing element 62, which is securely connected to the plug body 32. The first leg 56 fits snugly against the inner housing wall. The second leg 58 presses against the plug body 32. At its end, the second leg 58 carries the end pin 64 so that the pressure is exerted across a somewhat wider surface area.

Figure 12:
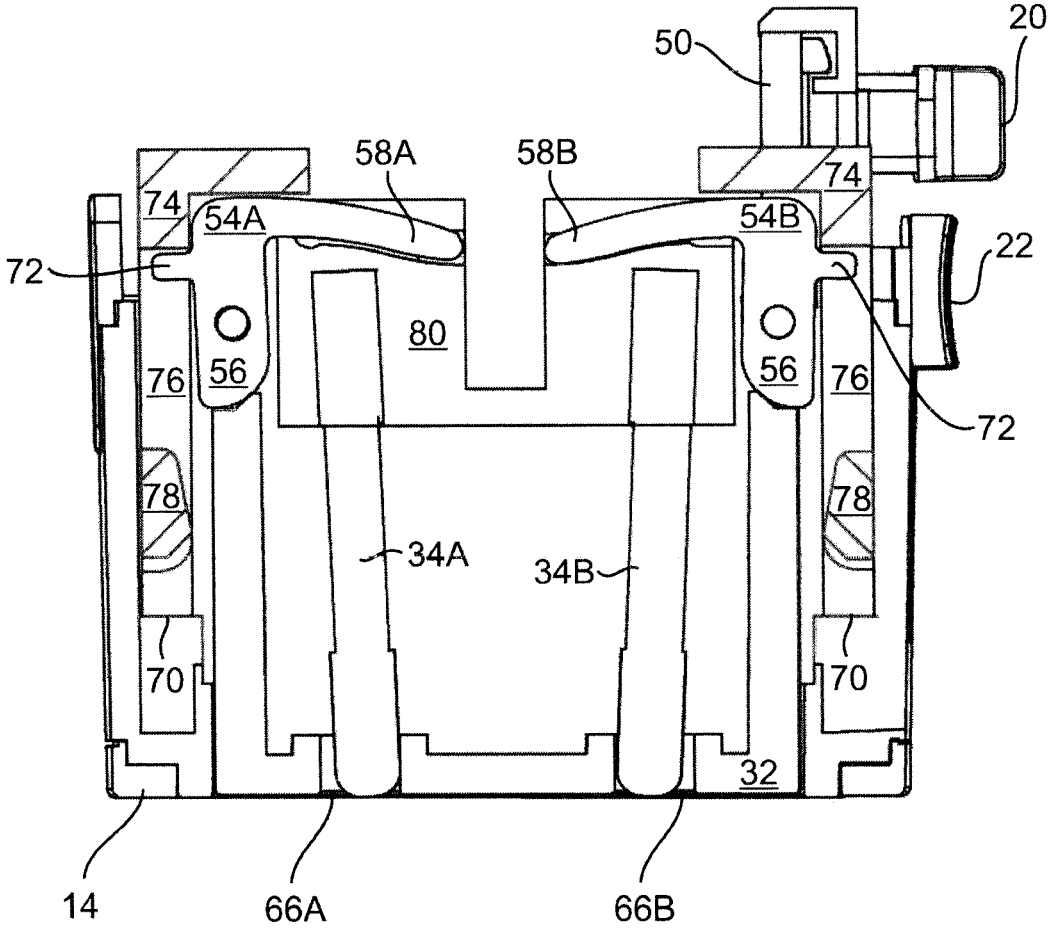
FIG. 12 is a side view of selected cooperating components.

FIG. 12 illustrates cooperating components in a sectional view. The sectional view largely corresponds to the view in FIG. 7, but in this case is less simplified and a more complete cross-section of an embodiment of an inventive travel adapter is depicted. Again visible are the first actuation slider 22 and the associated guide arm 50. When the sliding selector button 32 is in the appropriate position, it permits the actuation slider 22 to displace the plug body 32 downward out of the housing 14. During this movement, the two angle levers 54A and 54B move downward together with the plug body 32. The guide projections 72 of the angle lever follow this movement. The guide projections run in the guide track 74. The guide track surrounds the guide projections on both sides (that is, above and below the plane of the cross-section). The guide projections 72 may initially run freely in the guide groove 76 provided in the plane of the cross-section.

During its further downward movement, the guide projections 722 each strike a projection 78. The guide projections are pressed inward by this projection. Consequently the two legs 58A and 58B are pressed downward. This first downward movement acts on the support body 80. The support body bears the contact pins 34A and 34B provided on the Euro plug. Consequently, the contact pins move through the contact through-holes 66A and 66B.

The guide projections 72 striking the projections 78 also causes the first legs or actuation elements 56 to project outward into the guide groove 76.

During the further "second" downward movement of the plug, and in particular of the support body 80, the first legs therefore come to be positioned against the contact surfaces 70. As depicted in the previous figures, this causes the two second legs to be pressed completely downward (in other embodiments the second legs could also act directly on the contact pins to be moved).

It may also be seen from the depiction that the relatively short displacement path of the first actuation slider 52 is sufficient for move both the plug body 32 and the contact pins 34 completely out of the housing.

Figure 13:
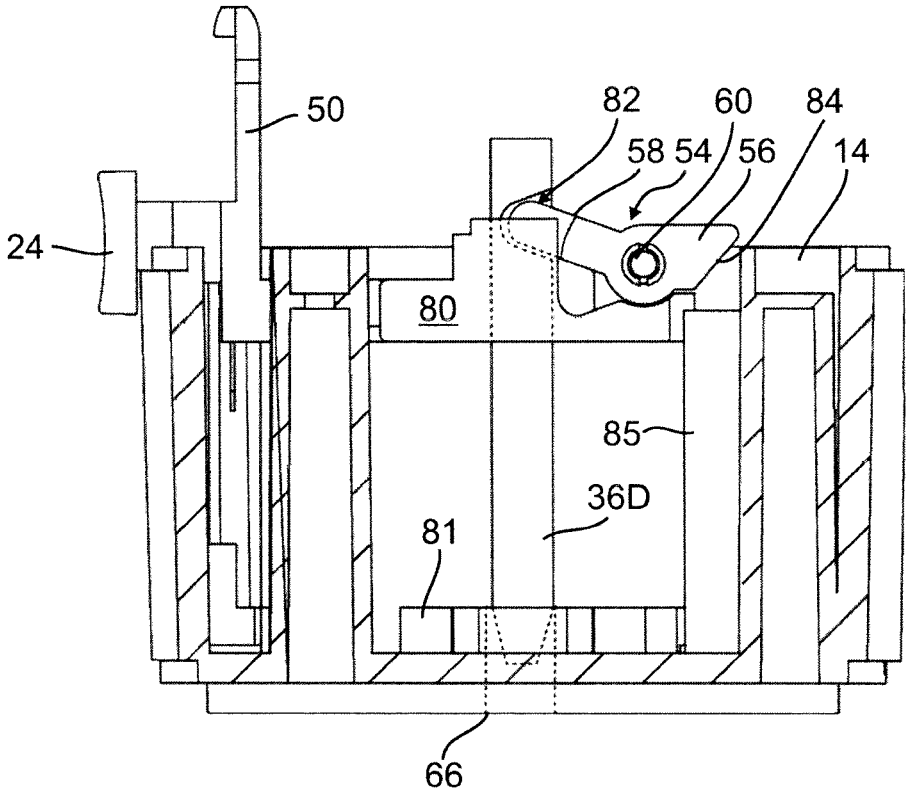
FIG. 13 is a side view of selected cooperating components.

FIG. 13 is a different sectional view through an embodiment of an inventive travel plug adapter. In this cross-section, the ground terminal 36D of the UK plug is visible. According to the corresponding standard, the ground terminal must project farther than the two contacts of the UK plug. The contacts may usefully be guided on the support body 80. The support body 80 is connected to the second actuation slider 24. The second actuation slider 24 is also connected to a guide arm that permits its release or locking via the selector element (not shown).

The actuation slider 24 may also guide the support body 80 downward within the housing 14. If the support body 80 is disposed in the stop position at the stop surface 81 in the housing, then the contacts are displaced in their usage position, but the UK ground terminal 36D must be displaced even farther out of the housing 14. An angle lever 54 is again provided for this purpose.

The actuation lever 54 again has a first leg 56 that acts as actuation element. In opposition thereto it has a second leg 58. The angle lever is borne by the axis 60, which in this case is connected to the support body 80. In general it is useful when the support body bears the axis of the angle lever.

The UK ground terminal pin 36D has a bushing 82 in which the second leg of the angle lever 54 engages. This permits a good mechanical connection between angle lever 54 and the ground terminal pin 36D. The bushing is configured open enough that the second leg 58 has the necessary clearance, that is, can engage the bushing 82 from various angles.

During the downward movement of the support plate 80, the sloped surface 84 comes to be positioned against the housing, or more precisely, the sloped surface 84 runs on the slide surface 85. Due to the slope, this leads to a large movement angle of the angle lever 54. Providing a sloped surface on the actuation element of the angle lever is in general an inventive concept.

Figure 14:
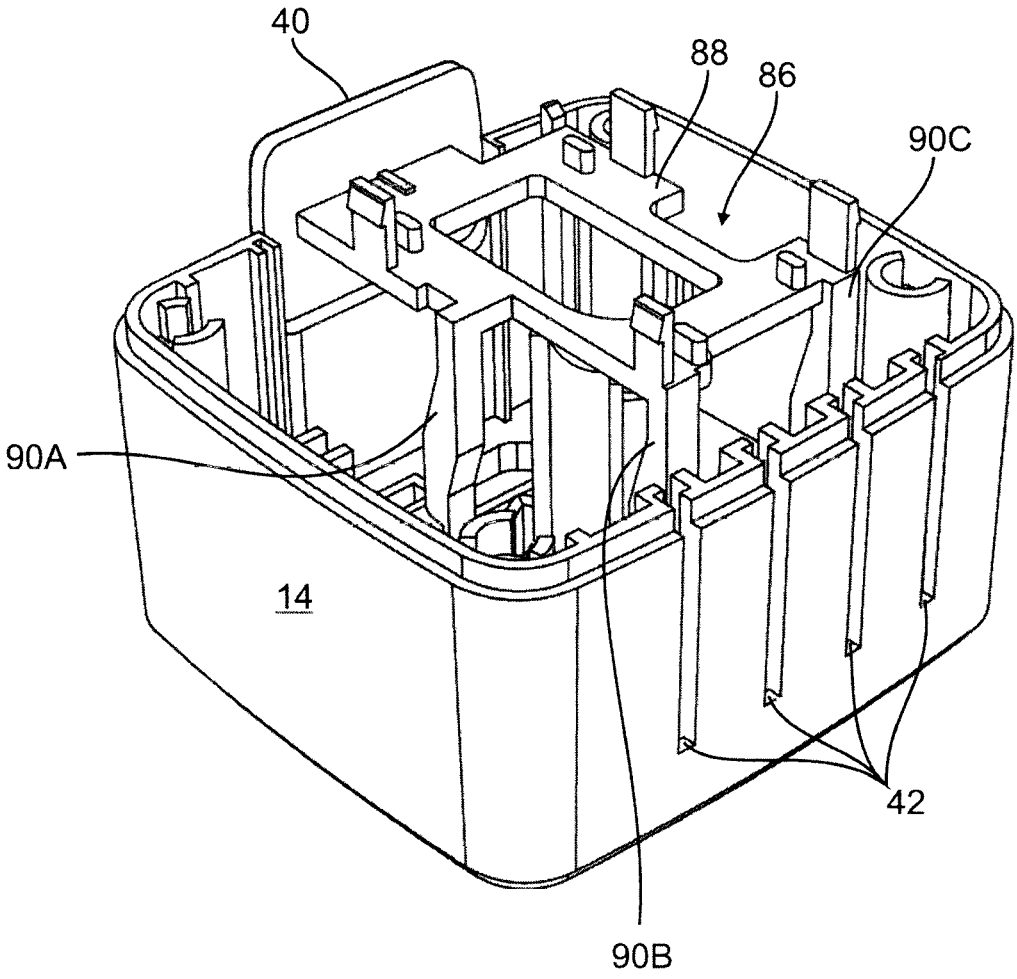
FIG. 14 is a perspective elevation of two cooperating components.

FIG. 14 is a perspective depiction of two other cooperating components of one embodiment of the travel plug adapter. The components are also depicted in their "natural" position, i.e., in the position they would assume in the complete travel plug adapter. Depicted are the lower housing part 14 and the locking element 86. In a known manner, the lower housing part has four mutually parallel slide slots 42. The locking element 86 has the release button 40, which is already known. It also has a frame 88. The frame 88 is equipped with fastening clips (not described in greater detail) that permit the locking element 86 to be attached to other elements of the travel plug adapter. The locking element 86 furthermore has three locking legs: the first locking leg 90A, the second locking leg 90B, and the third locking leg 90C.

Figure 15:
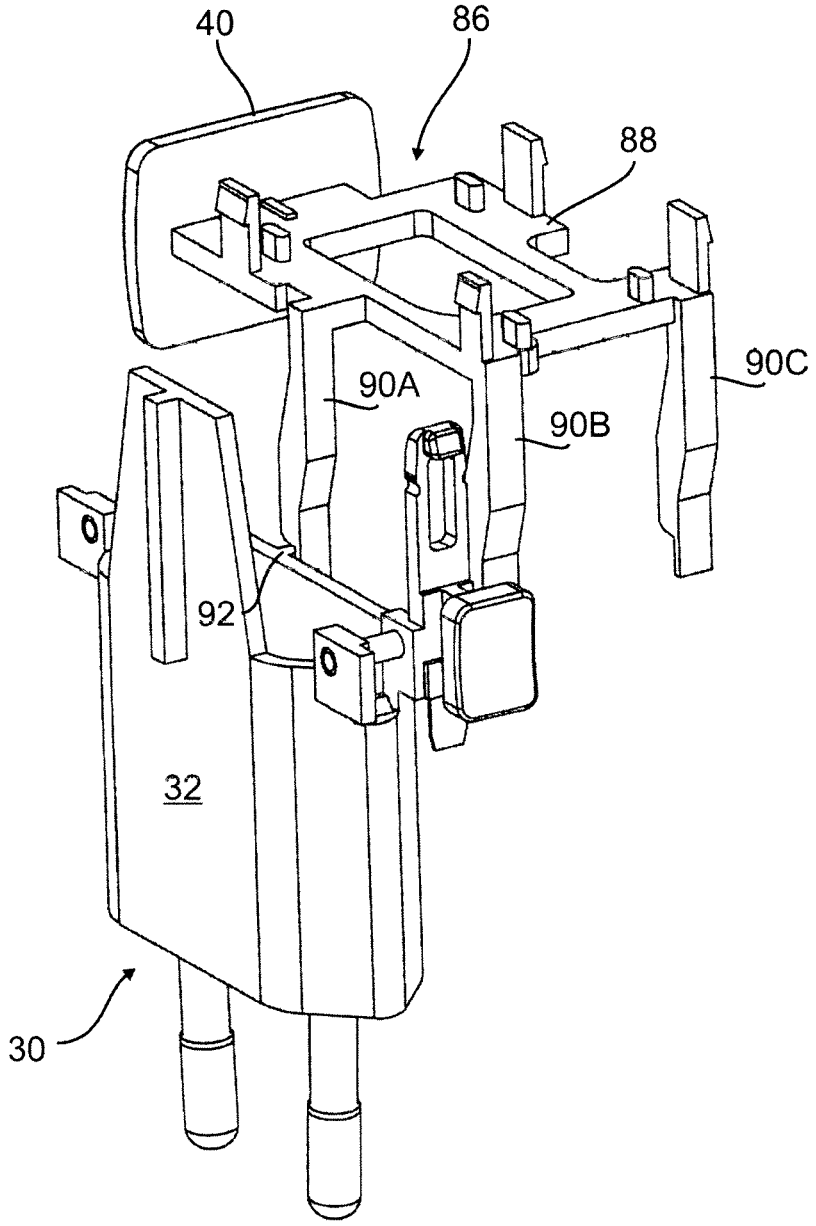
FIG. 15 is a perspective elevation of two other cooperating components.

FIG. 15 illustrates how the locking legs function. In this figure, the locking element 86 is shown without the lower housing part 14, but with the plug body 32 for the Euro plug. The locking element 86 also cooperates with other plug bodies and contact pins; however, the action shall only be described here using the example of the Euro plug, and therefore the corresponding plug body 32. The plug body is securely connected to the first actuation slider 22, which has a guide arm 50. The plug body 32 is also connected to a sliding projection 92. The sliding projection can slide along the first locking leg 90A and can assume a locking position at the lower end of the first locking leg 90A.

Figure 16:
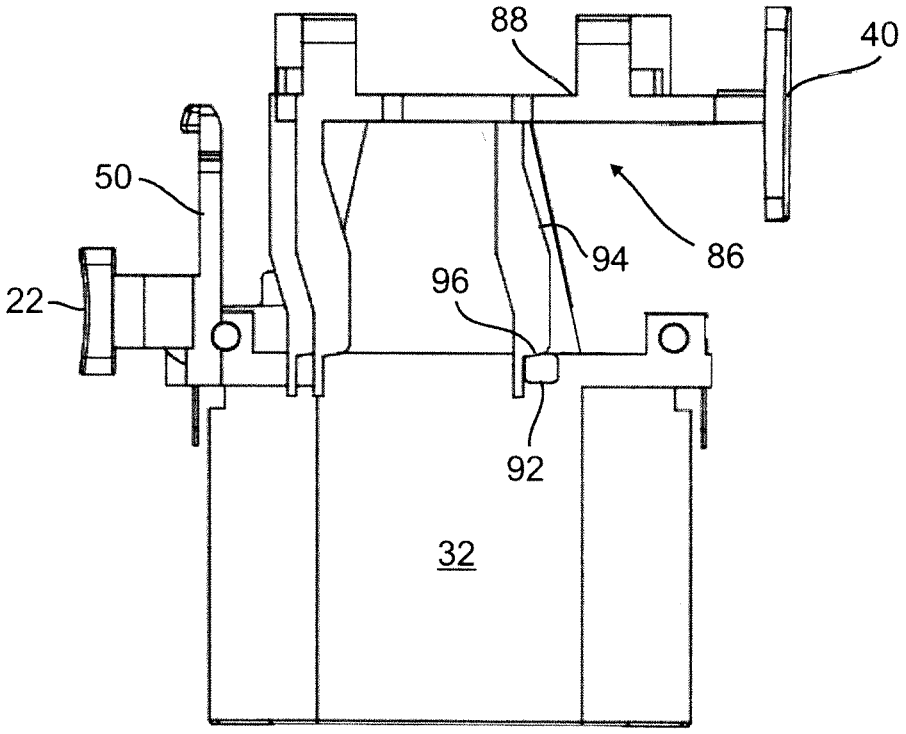
FIG. 16 is a side view of the components from FIG. 15.

FIG. 16 illustrates the elements known from FIG. 15, but this time in a side view, from which view the precise manner of functioning may be seen even better. In this view, it may be seen that the first locking leg 90A (like the other locking legs, as well) has a slide surface 94 and a locking projection 96. The sliding projection 92 of the plug body 32 may slide along on the slide surface 94. To enable the sliding, the locking element 86 is movable laterally, i.e., in the release direction defined by the orientation of the release button 40 (a direction from right to left in this view). The locking element 86 is resiliently prestressed such that the sliding projection 92 is pressed against the slide surface 94. When the plug body 32 reaches its usage position, the sliding projection 92 reaches the locking projection 96. Since the locking element 66 is resiliently prestressed (such that, in this depiction, it is therefore pressed to the right), the sliding projection 92 moves under the locking projection 96 and is thus arrested. This arrest is very beneficial mechanically, since the locking leg 90A is loaded along its primary extension direction and thus essentially only has to absorb compression forces. By pressing the release button 40, the arrest may be reliably released, however, and the plug body may be moved along the slide surface 94 back into its standby position.

In the manner described generally, and described more specifically in the drawings, a travel adapter may be produced that is very comfortable to operate, but in which almost no operating errors are to be expected. Interestingly, the travel adapter is nevertheless inexpensive to produce and may also be produced inexpensively and reliably even if greater fault tolerances must be permitted during mass production.

REFERENCE LIST

10 Travel plug/travel plug adapter
12 Upper housing part

14 Lower housing part
16 Plug receptacle
18 Female connector
18A UK female connector pair
18B AUS female connector pair
18C US female connector pair
18D Female connector for UK ground pin
20 Operating button for sliding selector
22 First actuation slider
24 Second actuation slider
26 Third actuation slider
28 Fourth actuation slider
30 Euro plug
32 Plug body
34 Contact pin
36 Contact pins
36A UK contact pins
36B AUS contact pins
36C US contact pins
36D UK ground terminal
38 Fuse insert
40 Release button
42 Slide slot
44 Sliding selector body/sliding selector
46 Recess for release button
48 Blocking cam
50 Guide arm
52 Engaging element/engaging cam
54 Angle lever
56 Actuation element/first leg
58 Second leg
60 Second leg
62 Bearing element
64 End pin
66 Contact pin through-hole
68 Contact projection
70 Contact surface
72 Guide projection
74 Guide track
76 Guide groove
78 Projection
80 Support body
81 Stop surface for support body
82 Bushing (in contact pin)
84 Sloped surface
85 Slide surface
86 Locking element
88 Frame
90 Locking leg
92 Sliding projection
94 Slide surface
96 Locking projection

The invention claimed is:

1. Travel plug adapter (10) having a housing with inner walls, outer walls, and a bottom surface and furthermore having a plug receptacle (16), and at least a first plug (32) of a first standard that has at least a first contact pin (34), wherein the first plug, by being displaced along a first distance (D1), may be moved out of a standby position, in which the plug is essentially disposed within the housing, into a usage position, in which the plug is usably disposed outside of the housing, characterized in that a contact surface (70) is provided in the housing and the plug is connected to at least one actuation element (56) that, when the plug is moved from the standby position into the usage position, at least temporarily, comes into contact with the contact surface (70) and that is connected to a transmission unit (54) such that by the transmission unit (54) the at least one contact pin is moved along a second distance (D2) that is greater than the first distance (D1), and the first plug is associated with an actuation slider and in which the actuation slider also only moves along the first distance (D1) which is smaller than the second distance (D2).

2. Travel plug adapter (10) according to claim 1, in which the transmission unit comprises a gear mechanism.

3. Travel plug adapter (10) according to claim 1, in which the transmission unit is an angle lever (54).

4. Travel plug adapter (10) according to claim 1, in which the first plug bears an angle lever (54).

5. Travel plug adapter (10) according to claim 4, in which the first plug comprises an axis (60) about which the angle lever (54) may rotate.

6. Travel plug adapter (10) according to claim 1, in which the first plug is embodied as a Euro plug (30).

7. Travel plug adapter (10) according to claim 6, in which the Euro plug (30) comprises a plug body (32) that bears two angle levers (54).

8. Travel plug adapter (10) according to claim 1, in which the first plug is embodied as a UK plug.

9. Travel plug adapter (10) according to claim 8, in which an UK ground terminal (36D) moves by the second distance.

10. Travel plug adapter (10) according to claim 1, in which the contact surface (70) is provided on an inner wall of the housing.

11. Travel plug adapter (10) according to claim 1, in which furthermore a locking element (86) is provided that locks at least the first plug in the usage position.

12. Travel plug adapter (10) according to claim 11, in which the locking element (86) is connected to a release button (40) provided on the outside of the housing.

13. Travel plug adapter (10) according to claim 11, in which the locking element (86) has at least one locking leg (90), wherein the locking leg (90) has a slide surface (94) and locking projection (96).

14. Travel plug adapter (10) according to claim 13, in which at least one plug has a sliding projection (92) that runs on the slide surface (94) and can assume a locking position on the locking projection (96).

15. Travel plug adapter (10) according to claim 1, in which at least the first plug is connected to an actuation slider (22, 24, 26, 28) and the housing has slide slots (42) for receiving the actuation slider (22, 24, 26, 28).

16. Travel plug adapter (10) according to claim 2, in which the contact surface (70) is provided on an inner wall of the housing.

17. Travel plug adapter (10) according to claim 2, in which furthermore a locking element (86) is provided that locks at least the first plug in the usage position.

18. Travel plug adapter (10) according to claim 12, in which the locking element (86) has at least one locking leg (90), wherein the locking leg (90) has a slide surface (94) and locking projection (96).

19. Travel plug adapter (10) according to claim 2, in which at least the first plug is connected to an actuation slider (22, 24, 26, 28) and the housing has slide slots (42) for receiving the actuation slider (22, 24, 26, 28).

20. Travel plug adapter (10) according to claim 3, in which at least the first plug is connected to an actuation slider (22, 24, 26, 28) and the housing has slide slots (42) for receiving the actuation slider (22, 24, 26, 28).

* * * * *